US006331132B1

(12) United States Patent
Watson

(10) Patent No.: US 6,331,132 B1
(45) Date of Patent: Dec. 18, 2001

(54) YO-YO HAVING IMPROVED TETHER TENSION CONTROL AND ADJUSTABLE MECHANISM

(75) Inventor: Donald W. Watson, Rohnert Park, CA (US)

(73) Assignee: What's Next Manufacturing, Inc., Arcade, NY (US)

( * ) Notice: Subject to any disclaimer, the term of this patent is extended or adjusted under 35 U.S.C. 154(b) by 0 days.

(21) Appl. No.: 09/361,650

(22) Filed: Jul. 27, 1999

(51) Int. Cl.[7] ..... A63H 1/30
(52) U.S. Cl. ..... 446/250
(58) Field of Search ..... 446/247, 248, 446/250, 263

(56) References Cited

U.S. PATENT DOCUMENTS

| | | | | |
|---|---|---|---|---|
| 2,629,202 | * | 2/1953 | Stiver et al. | 446/250 |
| 3,175,326 | * | 3/1965 | Isaacson | 446/250 |
| 4,130,962 | * | 12/1978 | Ennis | 446/250 |
| 5,017,172 | * | 5/1991 | Seifert | 446/250 |
| 5,100,361 | * | 3/1992 | Kuhn et al. | 446/250 |
| 5,184,972 | * | 2/1993 | Tomberlin | 446/250 |
| 5,813,897 | * | 9/1998 | Van Dan Elzen et al. | 446/250 |
| 5,813,898 | * | 9/1998 | Van Dan Elzen et al. | 446/250 |
| 5,984,759 | * | 11/1999 | O'Sullivan | 446/250 |
| 6,004,183 | * | 12/1999 | Dixon et al. | 446/250 |

FOREIGN PATENT DOCUMENTS 2132100.00 * 7/1984 (GB) .

* cited by examiner

*Primary Examiner*—John A. Ricci
(74) *Attorney, Agent, or Firm*—Simpson, Simpson & Snyder, PLLC

(57) ABSTRACT

An improved yo-yo, having a first yo having a first inwardly facing surface; a second yo having a second inwardly facing surface, the second yo arranged in spaced apart relation to the first yo, where the first and second inwardly facing surfaces face one another; an axle secured to and arranged between the first yo and the second yo, where the first and second yos are arranged for rotation about an imaginary axis coincident with the axle; and, a first fibrous pad secured to the first inwardly facing surface. Another embodiment comprises an improved yo-yo, having a first yo having a first inwardly facing surface; a second yo having a second inwardly facing surface, the second yo arranged in spaced apart relation to the first yo, creating a gap having a length between the first and second inwardly facing surfaces; an axle having a first end and a second end, the first end adjustably secured within a partial through-bore in the first yo, the second end fixedly secured within a partial through-bore in the second yo, where the first and second yos are arranged for rotation about an imaginary axis coincident with the axle; and, a ratchet assembly mounted to the axle and operatively arranged to change the length of the gap in response to rotation of the first yo relative to the second yo.

26 Claims, 7 Drawing Sheets

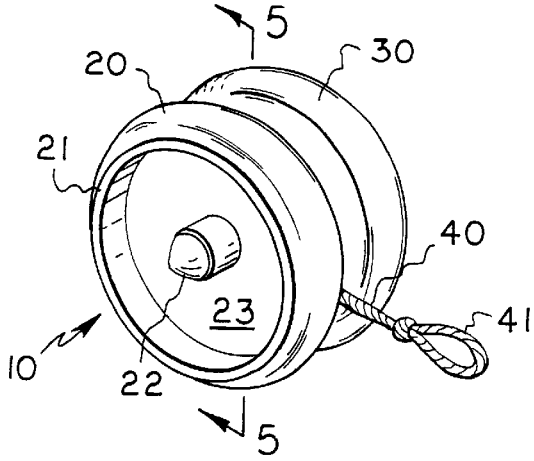
FIG. 1
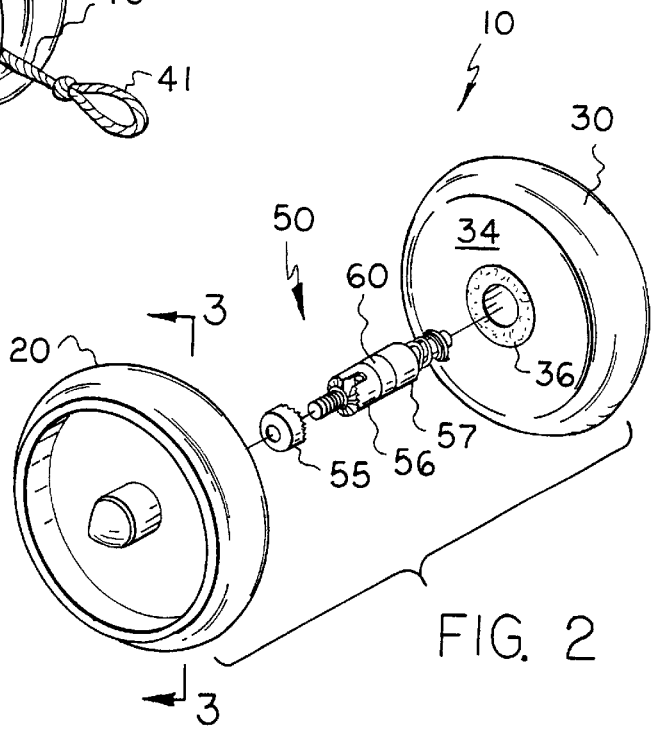
FIG. 2
FIG. 3
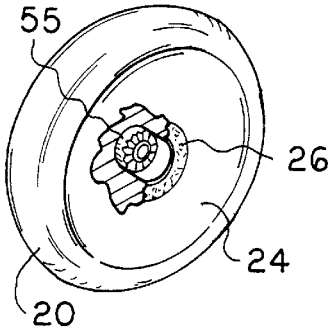
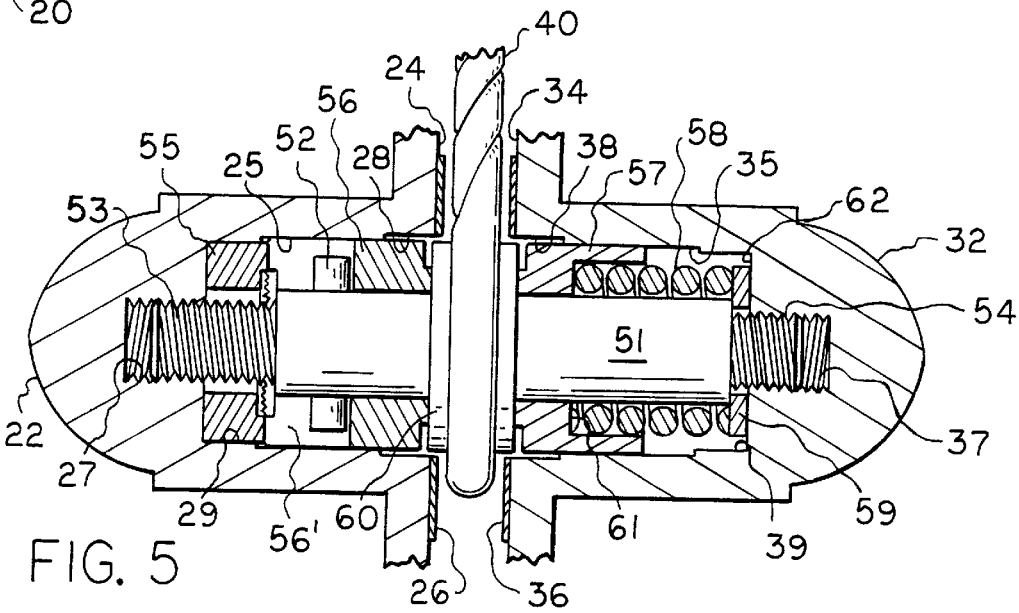
FIG. 5

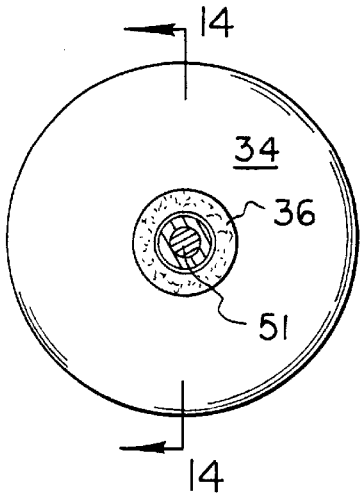
FIG. 13
FIG. 14
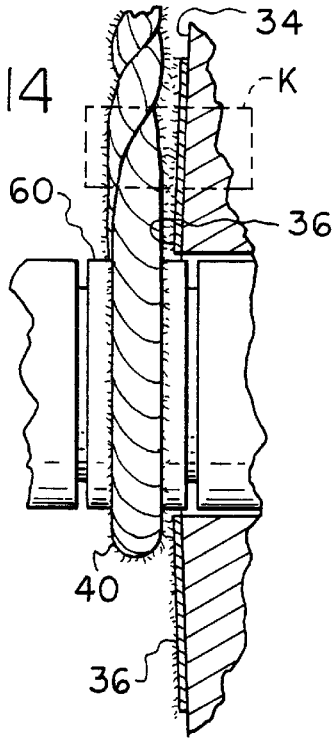
FIG. 15
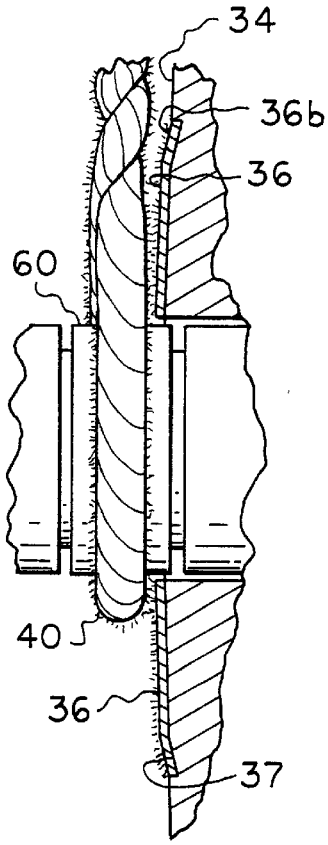
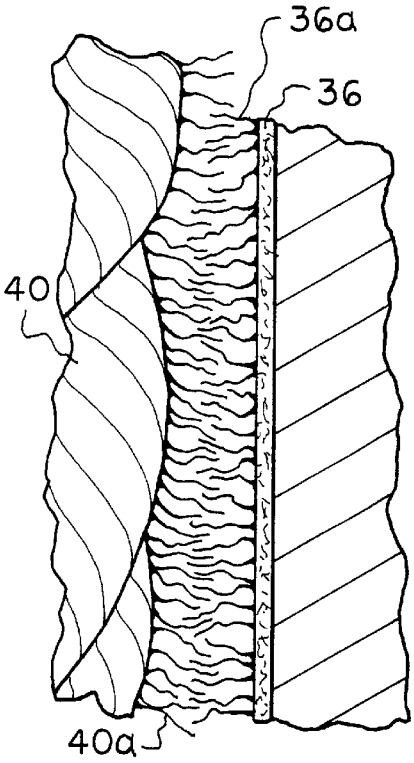
FIG. 16

FIG. 20
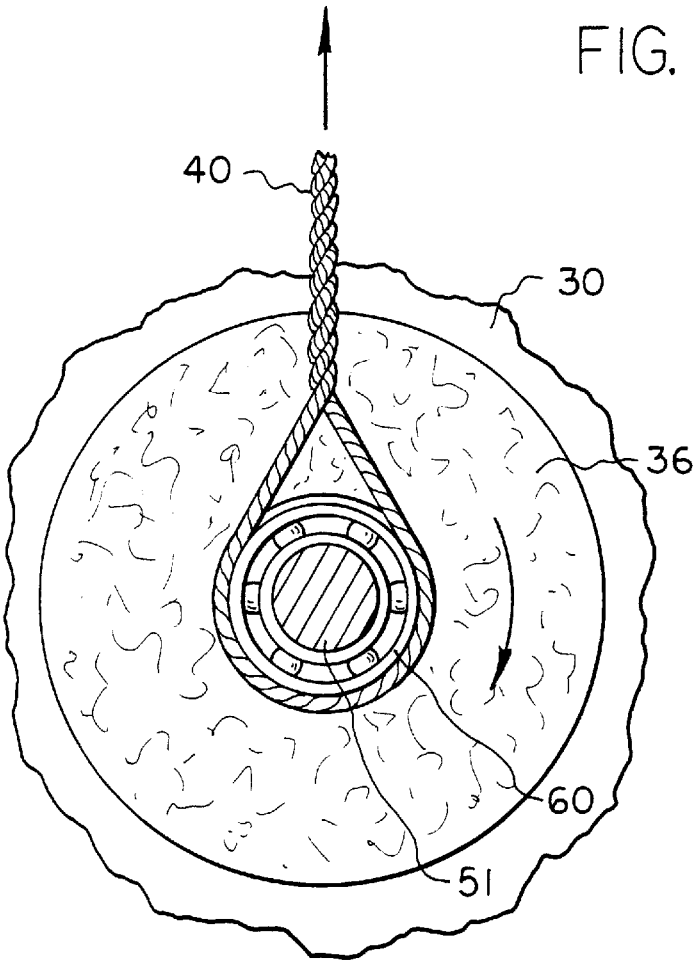
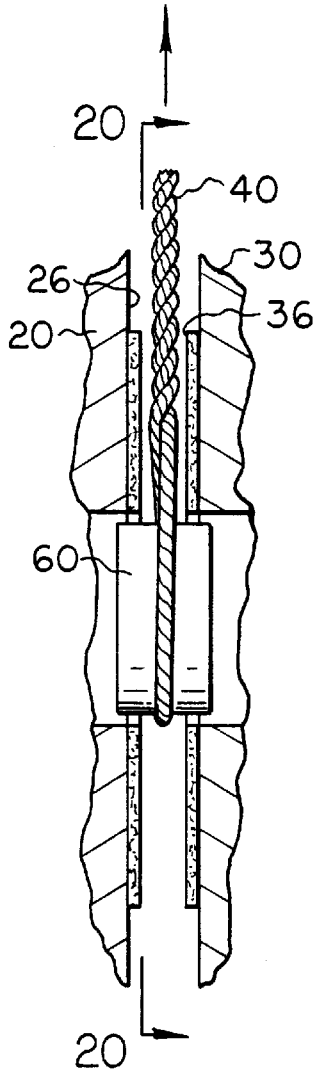
FIG. 19

YO-YO HAVING IMPROVED TETHER TENSION CONTROL AND ADJUSTABLE MECHANISM

FIELD OF THE INVENTION

The present invention relates generally to hand-operated toys, specifically to yo-yos, and, more particularly, to a yo-yo having an improved tether tension control and adjustment mechanism. The tension control mechanism comprises a pair of fibrous pads detachably secured to the inwardly facing surface of each yo proximate the axle, and the tension adjustment mechanism comprises a ratchet-like gap adjustment mechanism.

BACKGROUND OF THE INVENTION

It is widely believed that yo-yos originated in China, although the earliest recorded documentary evidence of the toy comes from Greece, circa 500 BC. The yo-yo has long been extremely popular among children of the Philippines. A picture of a girl in a red dress playing with her yo-yo appears on a box from India made in the year 1765. During the late 18th century, the yo-yo gained popularity among the aristocracy of Scotland, France and England.

The usefulness of the yo-yo as a stress reliever is widely known. In fact, it is reported that unfortunate people played with their "emigrettes" (French term for yo-yo) to reduce tension on their way to the guillotine.

Yo-yos were probably introduced to the United States in the 19th century. There are several patents related to yo-yos in the 1860's, referring to them as "bandalores" and "return wheels". Perhaps one of the earliest references to the term "yo-yo" in the United States was a Jul. 1, 1916 Scientific American Supplement describing various Filipino toys and explaining that "yo-yo" was derived from the Filipino word for "come-come". This origin was later corroborated by Dr. Henry Lee Smith, Jr. in the famous Duncan yo-yo trademark case of 1965. Dr. Smith, who was then Chairman of the Department of Anthropology and Linguistics and Professor of Linguistic English, State University of New York at Buffalo, testified in the case as an expert liguist and etymologist that it was his opinion that the word "yo-yo" is a Malayo-Polynesian word of Philippine origin, and that the toy itself was of Oriental origin.

The first large-scale commercial yo-yo production in the United States can be traced to Pedro Flores of the Philippines, who brought the first Filipino yo-yo to the United States and opened a yo-yo manufacturing company under his own name in 1928. Flores' yo-yos were made of wood and included a string looped about the axle, permitting the yo-yo to "sleep" and do other tricks.

The Flores yo-yo company was purchased by Donald F. Duncan Sr. in the late 1920s. The Duncan Company prospered for many years as a leading producer of yo-yos, producing tens of millions of yo-yos each year. During the time period of 1932–1965, Duncan actually owned a federal trademark registration for the term "yo-yo". The term was judged to be generic, and therefore incapable of trademark significance in Donald F. Duncan, Inc. v. Royal Tops Manufacturing Company, Inc., 144 USPQ 617 (7th Cir. 1965). Later in the same year, the Duncan Company filed for bankruptcy.

The yo-yo has been known by many names over the years including: L'emigrette (French for "leave the country"), de Coblenz (name of a French city to which many French fled), joujou de Normandie, bandalore, quiz, incroyable, Prince of Wales, return wheel, return top, come-back, return, whirl-a-gig and twirler. One patent even refers to a specially designed yo-yo as, "A toy having combined rotational motion about a horizontal axis and translational motion in a vertical direction." (U.S. Pat. No. 4,290,224, Sept. 22, 1981, Abstract).

Despite the numerous names by which the toy has been known, and the numerous yo-yo manufacturers making yo-yos over the years, basic yo-yo design has changed very little over the years. Originally, all yo-yos made in the United States were made of wood. The original shape was known as the "Imperial". The Imperial, or standard shape yo-yo, is especially suitable for loop tricks.

The Duncan Company later introduced the Butterfly design. The design of the Butterfly reverses the halves of a traditional Imperial design yo-yo. The Butterfly design is especially attractive to young players because it is very easy to catch, although somewhat uncomfortable to hold. Duncan and others also pioneered the switch from wood to plastic in yo-yo manufacture.

Most design changes in yo-yos have come about in an effort to improve the ability of the yo-yo to perform certain tricks. There are hundreds of known yo-yo tricks. Among the better known are the Sleeper (AKA The Spinner), the Forward Pass, the Breakaway, the Creeper, Rock the Baby, the Buzsaw, the One Handed Star and the Bank Deposit. While the Duncan Company pioneered the use of touring professionals who demonstrated yo-yo tricks, there are presently yo-yo competitions and shows on regional, state, national and international levels.

There are three basic yo-yo characteristics that enable most tricks. First, the yo-yo must be capable of sleeping for an extended period of time. A yo-yo is said to "sleep" when it has been released from the user's hand, and begins to rapidly spin about its axis at the end of the tether without return. At the end of a sleeping trick the user then tugs or jerks on the tether to cause the yo-yo to return. A second desired characteristic is that of avoiding inadvertent snagging or grabbing of the tether, causing premature return. A third and final desired characteristic is the ability of the yo-yo to return on command. Various manufacturers have offered design improvements to address one or more of these desired characteristics. Recently, manufacturers have attempted to design yo-yos having characteristics that can be changed on demand or between or even during tricks.

The dynamics of "sleeping" are explained in U.S. Pat. No. 5,100,361 (Kuhn and Watson)(1992). In this patent, directed to the commercially available SB-2™ adjustable yo-yo (available from What's Next Manufacturing Co., Inc. of Arcade, New York), it is explained that:

A Yo-Yo "sleeping" must be "waked"; that is caused to engage the string at the axle, initiating rewinding of the string in the space between the sides and, with momentum, return the Yo-Yo to the players hand "in " the Yo-Yo: a toy Fly Wheel, AMERICAN SCIENTIST, Vol. 72, March-April 1984, pp. 137–142, Wolfgang Burger explains that the sleeping Yo-Yo is waked by a sudden pull on the string. Consequent interactions between the string and the rotating parts of the Yo-Yo caused the string to be wrapped tightly around the axle, and in the space between the Yo-Yo sides, returning the Yo-Yo to the players hand. Burger mentions, "capstan friction", which occurs between the portion of string looped around the axle and the peripheral surface of the rotating axle, as an initiating cause for the rewinding of the string. Capstan friction acts to slow the spinning of the yo-yo resulting in undesirable, early termination of play in sleeping tricks; capstan friction also acts to fray the string at the axle resulting in short play life of the string and possible damage of the Yo-Yo if the string breaks during play. (U.S. Pat. No. 5,100,361, col. 1, lines 29–53; note that although the word "yo-yo" is capitalized in the text, What's Next Manufacturing Co, Inc., also assignee of the present patent, considers the phrase "yo-yo" to be a generic term, incapable of trademark significance.)

Attempts have been made to reduce and eliminate the aforementioned capstan friction in order to extend significantly the spin time in a single throw of the yo-yo.

During the 1970s, yo-yo manufacturers modified designs to distribute weight about the rim. For example, U.S. Pat. No. 3,805,443 (Donald Duncan Jr.) discloses a yo-yo with maximum weight distributed in the outer periphery and also has a uniquely shaped side member that enables the yo-yo to sleep for an extended period of time. This design change resulted in a longer sleep time.

U.S. Pat. No. 4,130,962 Ennis 1978 describes a smooth axle of reduced diameter providing lower friction, meaning in fact, lower retarding torque. It also disposes the weight of the yo-yo in the periphery of the disks. This provides the yo-yo with a flywheel effect by placing the weight of the yo-yo nearest periphery. Ennis also describes cone-shaped protuberances with rounded ends situated circularly on the inside spaces of the disks proximate the central axle where the rounded tip protuberance snare loose ends of the wind up string for wind up.

U.S. Pat. No. 4,895,547 (Amaral)(1990) describes the elimination of capstan friction between the string and axle by placing a low friction sleeve bearing on the central axle and looping the string around the sleeve. The invention also includes an arrangement of radially extending raised ribs extending from the inwardly facing surfaces of the yo-yo halves and arranged to engage the string when retrieving the yo-yo U.S. Pat. No. 3,175,326 (Isaacson)(1965) eliminates capstan friction by using a ball bearing on the central axle with a specialized ring mounted at the periphery of the bearing and with the string looped around the ring.

Each of the three patents cited above (Ennis, Amaral and Isaacson) describes yo-yo embodiments where no provision is made to adjust the width of the gap between the yo-yo sides. The aforementioned U.S. Pat. No. 5,100,361 (Tom Kuhn and Donald W. Watson)(1992)(SB-2) discloses a yo-yo having a frictionless axle bearing for extended spin time. This invention also offers infinitely fine adjustment of the gap between the sides of the yo-yo for thread engagement. The adjustment is done by separating the yo-yo halves, and adjusting the gap by means of a tool or fingernail. This enables the yo-yo gap to be preset to accomplish certain types of tricks. While this yo-yo is a major improvement over the prior art, it suffered from the requirement of disassembling the yo-yo to make the gap adjustment.

Other attempts to adjust the engagement tension on the tether include U.S. Pat. Nos. 5,813,897 and 5,813,898 (Van Dan Elzen et al.) which relate to yo-yos having a plurality of recessed grooves in the tether facing surface of each of the yo-yos side pieces. Embedded in the grooves are rubber pads that tend to grab the string, facilitating a more reliable return of the yo-yo. Both of these patents disclose a starburst pattern of the rubber pads. While these inventions offer definite improvements in string control, unfortunately the design of these yo-yos requires expensive machining of the yo-yo halves as well as intricate placement of the pads within the grooves. Moreover, the rubber pads tend to fray the string causing premature wear. Also, these inventions do not afford adjustment of the tether gap.

In addition to the major yo-yo developments discussed above, others have made significant contributions to the yo-yo art in a variety of areas.

In 1975, Gil C. Sanchez patented (U.S. Pat. No. 3,924,114) an illuminated yo-yo.

In 1980, Tom Kuhn patented (U.S. Pat. No. 4,207,701) the "No Jive 3-in-1" yo-yo, the first yo-yo which could be taken apart by hand and reassembled in either the Imperial or Butterfly configuration. This patented yo-yo was also the first to have a replaceable axle.

In 1980, Michael Caffrey patented (U.S. Pat. No. 4,332,102) "The yo-yo with a Brain", a yo-yo having a free-spinning sleeve bearing and centrifugal spring loaded clutch that cause an automatic return when the rotational speed slows to a predetermined rate.

In 1984, Patrick MacCarthy patented (U.S. Pat. No. 4,437,261) a yo-yo having a twist resistant string offering a greater torsional resistance to twisting about the axis of the string than other conventional strings.

In 1991, Thomas F. Haley patented (U.S. Pat. No. 5,035,667) a swivel device for preventing twisting of a yo-yo string.

In 1995, John J. McAvoy, Jr. patented (U.S. Pat. No. 5,254,027) an adjustable performance yo-yo capable of adjusting the frictional drag applied to the yo-yo string This invention is designed to maximize sleep time while simultaneously enabling return of the yo-yo to the hand at will.

In 1998, Donald F. Duncan et al. patented (U.S. Pat. No. 5,769,686) a yo-yo having a unique axle design and end pieces capable of retaining Pog-shaped inserts.

Despite the numerous advances in yo-yo design over the years, heretofore a yo-yo has not been invented that offers long sleep time, prompt and reliable return upon request by the user's hand, and adjustable gap adjustment without disassembly. There has clearly been a longfelt need for a yo-yo with these characteristics.

SUMMARY OF THE INVENTION

The present invention broadly comprises an improved yo-yo, having a first yo having a first inwardly facing surface; a second yo having a second inwardly facing surface, the second yo arranged in spaced apart relation to the first yo, where the first and second inwardly facing surfaces face one another; an axle secured to and arranged between the first yo and the second yo, where the first and second yos are arranged for rotation about an imaginary axis coincident with the axle; and, a first fibrous pad secured to the first inwardly facing surface. The invention also comprises an improved yo-yo, having a first yo having a first inwardly facing surface; a second yo having a second inwardly facing surface, the second yo arranged in spaced apart relation to the first yo, creating a gap having a length between the first and second inwardly facing surfaces; an axle having a first end and a second end, the first end adjustably secured within a partial through-bore in the first yo, the second end fixedly secured within a partial through-bore in the second yo, where the first and second yos are arranged for rotation about an imaginary axis coincident with the axle; and, a ratchet assembly operatively arranged to change the length of the gap in response to rotation of the first yo relative to the second yo.

A general object of the present invention is to provide a yo-yo capable of long sleep time and prompt return to the user's hand upon request.

Another object of the present invention is to provide a yo-yo having an adjustable tether gap, capable of fine adjustment without disassembly of the yo-yo.

A more specific object of the present invention is to provide a yo-yo having a nominal tether gap, which can be easily increased or decreased in width by the use, without disassembly of the yo-yo.

A further object of the invention is to provide tether tension control for a yo-yo which does not require excessive and expensive machining.

Still another object of the invention is to provide tether tension control for a yo-yo using parts that can be easily replaced when worn.

Yet another object of the invention is to provide tether tension control for a yo-yo which minimizes wear and fraying of the tether during use.

These and other objects, features and advantages of the present invention will become readily apparent to those having ordinary skill in the art upon a reading of the following detailed description of the invention, in view of the drawings and appended claims.

BRIEF DESCRIPTION OF THE SEVERAL VIEWS OF THE DRAWINGS

FIG. 1 is a perspective view of the improved yo-yo of the present invention;

FIG. 2 is an exploded perspective view of the yo-yo shown in FIG. 1;

FIG. 3 is a fragmentary perspective view of the yo-yo of the present invention, taken generally along line 3—3 in FIG. 2;

FIG. 5 is a cross-sectional view of the yo-yo, taken generally along line 5—5 in FIG. 1;

FIG. 13 is a view of the second yo of the yo-yo taken generally along line 13—13 in FIG. 6;

FIG. 14 is a fragmentary, partial cross-sectional view of the yo-yo taken generally along line 14—14 in FIG. 13, illustrating a flat surface mount of the annular fibrous disk of the invention;

FIG. 15 is a view similar to that of FIG. 14, but showing the annular fibrous disk mounted in a partially tapered groove;

FIG. 16 is a magnified view of area K in FIG. 14, showing the string/fibrous disk interface in detail;

FIG. 19 is a fragmentary partial cross-sectional view of the yo-yo showing the tether in a tension orientation; and, FIG. 20 is a fragmentary partial cross-sectional view taken generally along line 20—20 in FIG. 19.

DETAILED DESCRIPTION OF THE PREFERRED EMBOCIMENT

Figures 4, 6:
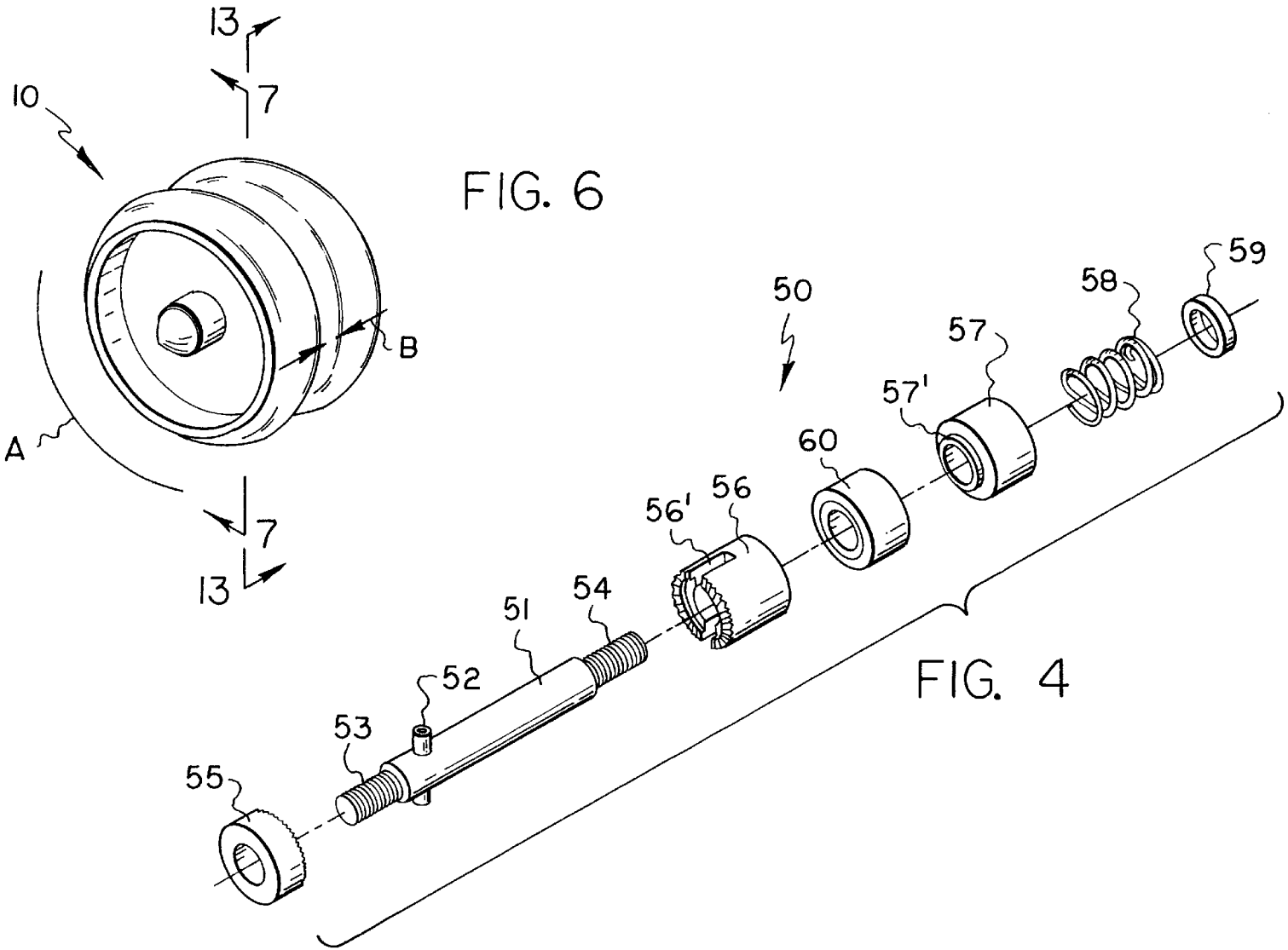
FIG. 4 is an exploded perspective view of the axle/ratchet/bearing assembly of the yo-yo shown in FIG. 2.
FIG. 6 is a perspective view of the yo-yo of the invention, similar to the view of FIG. 1, but marked to show how the individual yos of the yo-yo are turned relative to one another to adjust the ratchet mechanism of the invention.

At the outset, it should be understood that identical drawing reference numerals in different drawing views represent identical structural elements of the invention.

It is well settled that a patentee is entitled to be his own lexicographer. In the description that follows, then, the term "yo-yo" is intended to indicate a hand-operated toy, usually, but not always, operated by a single string or tether. The term "yo-yo" defines a toy that usually, but not always, comprises two side members connected by a common axle, to which the above-described tether or string is attached. The "yo-yo" of the present invention is intended to comprise structures made of wood, plastic, metal, or any other material. It is intended to include yo-yos of Imperial, Butterfly, "weighted rim", or other designs. The term "yo-yo" as it pertains to the present invention is intended to comprise the entire class of toys known by the names L'emigrette, de Coblenz, joujou de Normandie, bandalore, quiz, incroyable, Prince of Wales, return wheel, return top, comeback, return, whirl-a-gig and twirler.

In the description that follows, the singular term "yo" is used and hereby defined to be one of the two side members, or halves, of the yo-yo. Others in the prior art have referred to the yo as a side member, or as a halve of the yo-yo. All conventional yo-yos have two yos, although some unconventional designs are known to have three yos (these are operated by two strings). Each "yo" of the present invention is shown and described as a "rim-weighted" design, but the claims of the patent should not be interpreted as to include only the "rim-weighted" structure, but, rather, are intended to pertain to any yo-yo structure (Imperial, Butterfly, multi-yo, wooden, plastic, etc.). Also, the terms "string" and "tether" are synonymous, and intended to include any flexible member (tape, string, wire, etc.) used to play a yo-yo from one's hand, and attach it thereto. Although a yo-yo string or tether is a necessary element for playing a yo-yo, it is acknowledged that yo-yos may be made or sold without strings. For this reason, the independent claims of this patent do not recite the tether as an element. The tether is instead recited in appropriate dependent claims.

The terms "clockwise" and "counterclockwise" are taken from the perspective of one viewing the yo being described, with that yo's hub facing the viewer, and the tether located behind the yo. The term "inwardly" is taken from the perspective of a point in space facing from the hub toward the tether, whereas the term "outwardly" is taken from the perspective of a point in space facing the hub from the tether of the yo-yo, respectively. The terms "rightwardly" and "leftwardly" are taken from the perspective of one facing the drawing views. Structure Adverting now to the drawings, FIG. 1 illustrates yo-yo 10 in perspective. Yo-yo is shown as comprising first yo 20, second yo 30, and tether 40, shown to include finger loop 41. The first and second yo members are identical in a preferred embodiment, although the claims are not intended to be so limited. Because the yos are identical, for the most part, only yo 20 will be described in detail. The yo-yo shown in FIG. 1, and throughout the drawings, is a "rim-weighted" design, meaning that the weight distribution is concentrated in the periphery of the yo-yo. Yo 20, then, is seen to include rim portion 21, axle hub 22, and hollowed out portion 23.

Yo-yo 10 is shown in exploded perspective view in FIG. 2. The two yos are held together by axle/bearing/ratchet assembly 50, shown in more detail in exploded perspective view in FIG. 4. As seen in the drawing, the axle/bearing/ratchet assembly comprises axle 51 having a first threaded end 53 and a second thread end 54, and also including roll bar 52 extending transversely therefrom. The assembly also includes active ratchet member 55, passive ratchet member 56 having slot 56' (which engages roll bar 52), ball bearing 60, spring collar 57, spring 58 and washer 59. Operation of these various components will be discussed infra.

FIG. 5 is a fragmentary cross-sectional view of the yo-yo, taken generally along line 5—5 of FIG. 1. This view shows the mounting of the axle/bearing/ratchet assembly within the yo-yo. As shown, first yo 20 includes a stepped partial through-bore. There are four stepped sections: beginning at surface 24, section 28 has the largest bore diameter; section 25 has the next largest diameter; section 29 has the next largest diameter; and threaded section 27 has the smallest diameter. As shown, the partial through-bore sections of the first yo extend into hub 22. Similarly, second yo 30 includes a stepped partial through-bore. There are four stepped sections: beginning at surface 34, section 38 has the largest bore diameter; section 35 has the next largest diameter; section 39 has the next largest diameter; and threaded section 37 has the smallest diameter. As shown, the partial through-bore sections of the second yo extend into hub 32. First threaded end 53 of axle 51 is partially threaded into threaded bore 27; whereas second threaded end 54 is threaded into threaded bore 37. In practice, threaded end 54 is threaded more deeply into bore 37, and is tightened therein with an appropriate tool. On the contrary, yo 20 is merely hand-tightened on threaded end 53. Thus, turning second yo 30 counterclockwise will tend to remove the first yo from threaded end 53 before the axle unthreads from second yo 30.

Active ratchet member 55 is mounted in a press fit within bore section 29 within first hub 22. The press-fit active ratchet member is shown in partial cut-away view in FIG. 3, which is a fragmentary perspective view of yo 20 taken generally along line 3—3 in FIG. 2. Also shown in FIG. 3 is a plurality of ratchet teeth about the periphery of the active ratchet member. The teeth are facing inwardly.

Adverting once again to FIG. 5, passive ratchet member 56 is mounted on axle 51 proximate active ratchet member 55, and arranged such that roll pin 52, which extends transversely from the axle, engages slot 56' (best seen in FIG. 4). As best seen in both FIG. 2 and FIG. 4, passive ratchet member 56 also includes a plurality of teeth mounted about its periphery and facing outwardly. The passive ratchet teeth are operatively arranged for ratchet-like engagement with the active ratchet teeth, as will be described infra.

A conventional ball bearing 60 is mounted on the axle adjacent to the passive ratchet member. The inner race is slidably mounted to the axle and rotates therewith. The outer race is arranged for contact and engagement with tether 40. In operation, the tether keeps the outer race of the ball bearing stationary as the balls rotate, and the inner race, axle and yos spin.

Spring collar 57 is mounted to the axle proximate the bearing. As shown in FIG. 5, the spring collar is mounted in hub 32. The collar is generally cylindrical in shape, and includes a shoulder 61 which is arranged to engage spring 58. Spring 58 is a compression spring arranged in engagement between shoulder 61 and washer 59. Washer 59 is forced into engagement with surface 62 of hub 32. In a preferred embodiment, compression spring 58 was chosen to have a spring constant of nominally 150 lb./in. Springs having constants in the range of 140–160 lb./in. might also be suitable. In other embodiments, Belleville Spring Washers providing similar force might work as well. Neoprene or rubber O-rings in compression might also be suitable. As shown in FIG. 5, the compression spring exerts a biasing force on the spring collar, bearing and passive ratchet member, urging all of these members leftwardly, and urging the teeth of the passive ratchet member into engagement with the active ratchet member.

Also shown in FIG. 5 are fibrous pads 26 and 36, which are detachably secured to inwardly facing surfaces 24 and 34, respectively, of first yo 20 and second yo 30, respectively. The fibrous pads, or disks, are mounted to the inwardly facing surfaces of the yos proximate the axle. The pads are preferably detachable; that is, they may be removed and replaced as necessary. In a preferred embodiment, the fibrous pads are shaped in the form of annular disks, although other shapes would also be suitable. Also in a preferred embodiment, the disks are fabricated from woven linen cloth having roughly 100 threads per inch, extending outwardly in a variety of directions. In a preferred embodiment, the disks are coated with a non-permanent (e.g., repositionable) adhesive on one side, and replacement disks are shipped mounted on a release liner. The material from which these linen disks are fabricated is commonly available and intended for use in bookbinding and other graphic arts applications, but has heretofore never been used in yo-yos. In the preferred embodiment, the disks are detachably secured in order that they may be removed and then replaced when worn. However, the appended claims are intended to include in scope permanently secured fibrous disks as well. Also, although the disks in the preferred embodiment are made of linen, the claims are intended to encompass all similar or equivalent materials, i.e., materials that comprise a plurality of threads, fibers or whiskers extending therefrom. Such equivalent disks may be made of natural fibrous material or synthetic material.

In a preferred embodiment, the self-adhesive fibrous flat annular disks are typically slightly over ¾" in outside diameter, with a central hole of 0.325" diameter sized to clear the 0.312" outer diameter of the yo-yo ball bearing. The disks have a nominal thickness (including the release sheet) of 0.006". Of course, the dimensions of the disks may vary from yo-yo to yo-yo, and variations in dimensions are expected.

The disks are intended for use with almost any yo-yo capable of dismantlement, where at least one half of the yo-yo can be removed, making it possible to apply a disk to one side or a disk to each side of the yo-yo. To apply the disk, one simply removes (peels) the disk from the release liner and applies it centrally over the yo-yo sleeve or ball bearing axle, with the adhesive facing the inwardly facing surface of the yo. It is important that the inner diameter of the applied disk be everywhere spaced apart from the outer diameter of the sleeve or ball bearing about which it is placed; thus to assure free spinning of the yo-yo when tension remains on the yo-yo string. Obviously, any contact between a disk and the outer race would retard the spinning of the yo-yo.

FIG. 14 shows annular disk 36 detachably secured to inwardly facing surface 34 of yo 30. In this embodiment, inwardly facing surface 34 is seen to be flat. The surface is also seen to be closer to the tether proximate the axle than outwardly towards the perimeter of the yo-yo. Limited fraying of the disk at its outside peripheral edge is known to occur. While this fraying does not seriously diminish the effectiveness of the disk in interaction with the tether, FIG. 15 shows an alternate embodiment in which the inwardly facing surface 34 contains a tapered recessed surface 37. Outer peripheral portion 36*b* of annular fibrous disk 36 is detachably secured to this tapered surface, thereby minimizing the fraying.

The embodiment depicted in FIG. 14 provides the simplest design, and permits the fibrous disks to be used with existing yo-yos which do not have the tapered recess. The alternative embodiment, however, aside from avoiding the fraying, provides a more elegant and attractive appearance. In both embodiments, the disks may be removed by peeling them away from the yo's inwardly facing surface using any sharp, but preferably soft, instrument or tool. Any remaining adhesive may be removed with a solvent.

Assembly

In view of the above-described structure, assembly of the yo-yo is now described in more detail. These assembly instructions refer primarily to drawing FIGS. 2, 3, 4 and 5.

The first step in assembling the yo-yo is to firmly embed active ratchet member 55 in its bore in first yo hub 22. In a preferred embodiment, the ratchet member is embedded using a machinist's "interference fit" or "press fit". Other securing methods may be used, as long as the ratchet member becomes an integral part of the first yo. The embedded active ratchet member is shown most clearly in FIG. 3.

The axle/bearing/ratchet assembly is then assembled and installed. Passive ratchet member 56 is mounted with open slot 56' facing leftwardly towards roll pin 52. Ball bearing 60 is mounted with its inner race adjacent to the passive ratchet. The passive ratchet has a small collar (not shown) which contacts the inner race of the bearing, and keeps the member from contacting the bearing outer race. Spring collar 57 is then mounted adjacent the bearing. As seen in FIG. 4, spring collar 57 includes a small collar 57' which contacts the inner race of the bearing and prevents the collar from contacting the outer race of the bearing. (The small collar of the passive ratchet member is identical in appearance to collar 57'.) The spring collar is mounted with its smaller diameter opening facing the bearing, and its larger diameter opening facing away from the bearing.

Compression spring 58 is next installed, with its left end inserted into the larger diameter opening of the spring collar, and its right end in contact with washer 59, which is installed next. The washer is mounted to the right of the compression spring, leaving at least two exposed threads for subsequent engagement with the threaded bore of the second yo hub.

The fully composed axle/bearing/ratchet assembly 50 is now held in the left hand, and the assembly is inserted into the bore of the second yo hub. Threaded axle end 54 is threaded into engagement with threaded bore 37 of hub 32 by turning the assembly clockwise with the hand. The roll pin, captured in the slot of the passive ratchet, is here used as a crank to turn the axle. Once the axle is hand-tight in the second yo hub, an ordinary pliers is used to tightly grasp the passive ratchet (preferably made of hardened steel), and turn it further clockwise to very firmly seize the axle and in turn impinge the washer 59 firmly against inwardly facing surface 62 of second yo hub 32. The compression spring is now no longer relaxed, but is compressed almost fully, leaving still some space between adjacent coils. (Depending upon the length of the spring used, it may be necessary to include an additional thin shim spacer placed between the left end of the spring and the right-hand base of the bore end of the spring collar as shown in FIG. 5, to assure that maximum spring force is available for any given assembly.)

Assembly of the yo-yo is completed by mounting the first yo to the left threaded end 53 of the axle, engaging threaded bore 27 of first yo hub 22. Next, one turns second yo 30 clockwise while holding first yo 20 stationary, until a "first resistance" is felt.

The yo-yo is now completely assembled, and ready for "factory adjustment". The parts are positioned at the factory with only first contact between the teeth of the active and passive ratchet members. That is, the teeth are not in full engagement. All parts of the axle/bearing/ratchet assembly are held in place by the force of the compression spring, which is almost completely closed.

Operation

In view of the yo-yo structure recited above, the purpose of this improved yo-yo is two-fold. First, the ratchet assembly mechanism is intended to provide adjustment of the tether gap between the yos, without dismantling of the yo-yo, to achieve an optimum gap width known to provide best yo-yo performance. It is recognized that this optimum gap width may vary from trick to trick. The purpose is to allow further adjustment of the gap width in suitably fine increments to compensate for variances in string caliper and other variables that may negatively affect performance. Second, the fibrous disk assembly is intended to provide greater control over the yo-yo, and its interaction with the tether, primarily at the end of a trick. The goal is to provide more responsive return of the yo-yo to the hand upon request by the user. It should be obvious to the reader by now that the structural enhancements to a yo-yo which generally permit longer sleep times also tend to make the yo-yo less responsive to return on request. The improved ratchet mechanism and fibrous disk assembly of the present invention uniquely addresses both of these issues.

We discuss operation of the ratchet assembly first. In the embodiment just described, the axle screw threads (both ends) each comprise a common forty thread per inch, which equates to 0.025 inches per full turn of one yo relative to the other. The depth of the facing teeth of each ratchet member is roughly 0.006 inches. The ratchet members are each fabricated with 36 teeth per turn.

Figure 7:
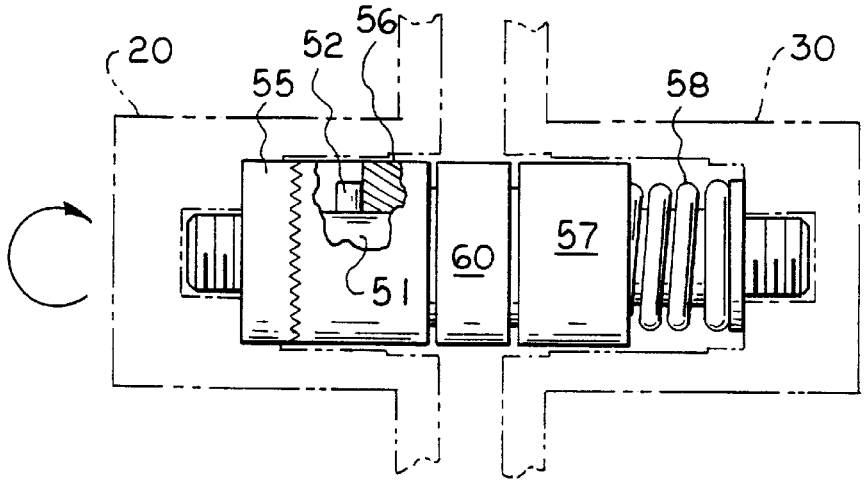
FIG. 7 is a fragmentary plan view of the axle/bearing/ratchet assembly of the invention, illustrating a point where the tether gap is a maximum.

Maximum gap width, shown in FIGS. 5 and 7, is achieved when the active and passive ratchet teeth are first fully engaged (meshed tip to root, one to the other). In mounting the first yo to the axle threaded end, that half is screwed into position "until a first resistance is felt". From that position, nominally one-quarter turn provides nominally nine sensible (to the touch and ear) "clicks" of the ratchet. In turning the first yo, it is important to recognize that the active ratchet member turns but the passive ratchet member, constrained by the roll pin in its slot, can only move laterally. As each of the nine clicks is completed, the active ratchet teeth are incrementally (1/36th of 0.025 inches, or about 0.0007 inches) further engaged with the passive ratchet teeth. At completion of the ninth click, the teeth are fully engaged (at the full 0.006 inches tooth depth); the right end of the passive ratchet slot is still very close to, if not still in contact with, the right side of the roll pin. In the present embodiment, with the adjustment just made, the gap width between the yos (ignoring the fibrous disks) is nominally 0.120 inches, a practical maximum gap width adjustment.

Figure 8:
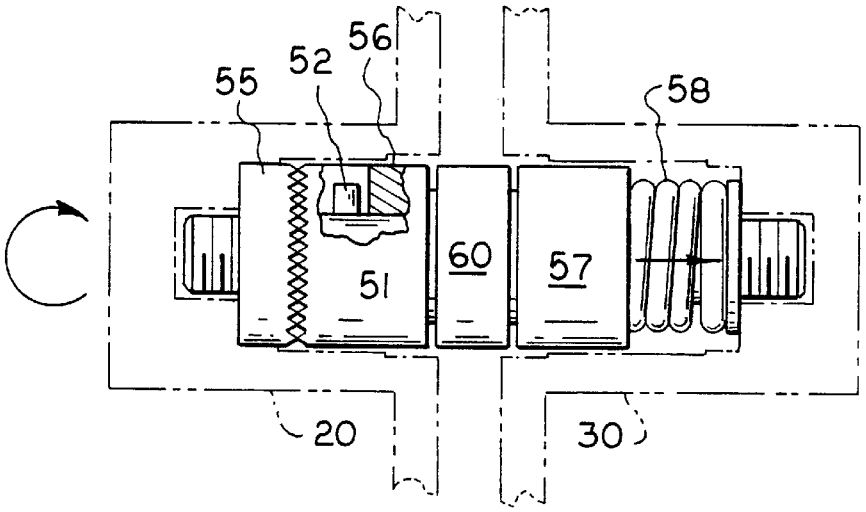
FIG. 8 is a view similar to that of FIG. 7, but at a point where the second yo has been turned clockwise ½ "click" of the ratchet relative to the first yo, such that the tooth points of the active and passive ratchet members are aligned.
Figure 9:
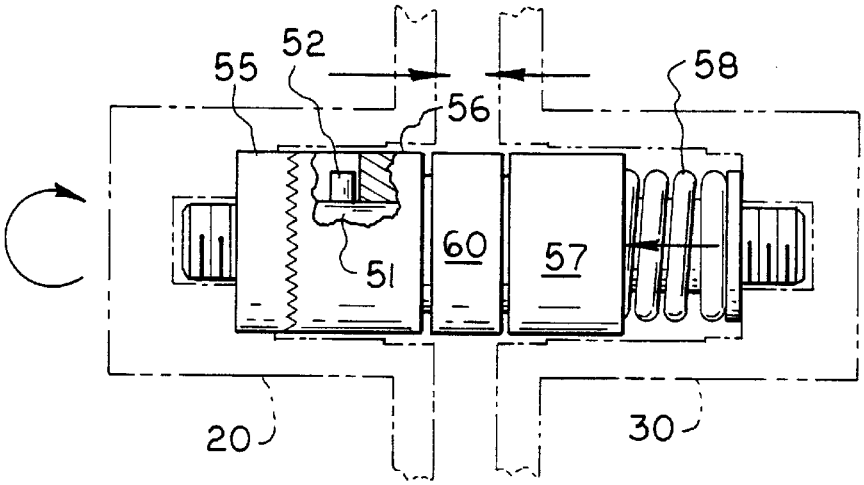
FIG. 9 is a view similar to that of FIG. 7, but at a point where the second yo has been turned clockwise 1 "click" of the ratchet, and the tether gap has been shortened relative to the gap shown in FIG. 7.

To further illustrate ratchet operation, FIG. 7 illustrates the yo-yo at its point of maximum gap width. As shown, at this point the teeth of the passive and active ratchet member are fully engaged. FIG. 8 illustrates a state of the ratchet mechanism a moment later in time with respect to FIG. 7, where the first yo has begun to rotate in a clockwise rotation. At this point in time, the teeth of the active ratchet are aligned in "point to point" alignment with the teeth of the passive ratchet. Finally, as the clockwise rotation continues, as shown in FIG. 9, the teeth become fully engaged once again. It is the transition between FIG. 8 and FIG. 9 where the player would hear and feel the "click" as the ratchet mechanism progresses. The gap illustrated in FIG. 9 would be slightly smaller than that shown in FIG. 7, and the axle has been threaded deeper into the threaded bore of the first yo hub.

In the present embodiment, a minimum of one full turn of adjustment is provided to the user; nominally a range in gap width of 0.025 inches. In finished yo-yos, the user will find that turning the second yo clockwise where moderate hand-applied torque will turn it no further, the string gap will be at the design minimum of nominally 0.095 inches. At this minimum gap width, the roll pin will not have moved but the passive ratchet, ball bearing, and spring collar will have been forced by the active ratchet to the right of the right side of the roll pin. Further, the inner face of the first yo is now 0.025 inches closer to the second yo. The inner face of the first yo now overreaches the right side of the ball bearing.

It is preferred in the present embodiment that the target gap width be achieved at the mid-point of the one full turn adjustment range. Thus, from the minimum gap width position just described, rotating the second yo one half turn counter-clockwise will widen the gap by about 0.012 inches to 0.107 inches between the yos (again ignoring the fibrous disks). In this position, the right end of the passive ratchet slot remains spaced away from the right side of the roll pin, but here only a nominal 0.012 inches.

The user is free to adjust the gap width by as much as 0.012 inches in either direction about the target gap width. The user can narrow the gap width by clockwise rotation of the second yo by as much as 0.012 inches; and the user can widen the gap width by counter-clockwise rotation of the second yo by as much as 0.012 inches. It is easily determined that the fine incremental adjustment from click to click of the ratchet teeth is $\frac{1}{36}$th of 0.025 inches, or less than 0.001 inches, and nominally 0.0007 inches.

Figure 10:
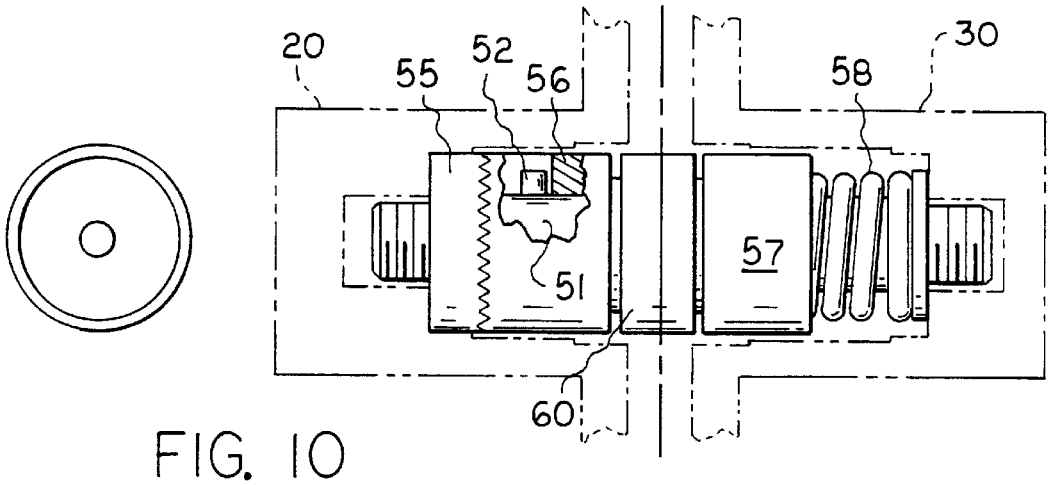
FIG. 10 is a view similar to that of FIG. 7, but illustrating the factory setting of the ratchet assembly and string gap.
Figure 11:
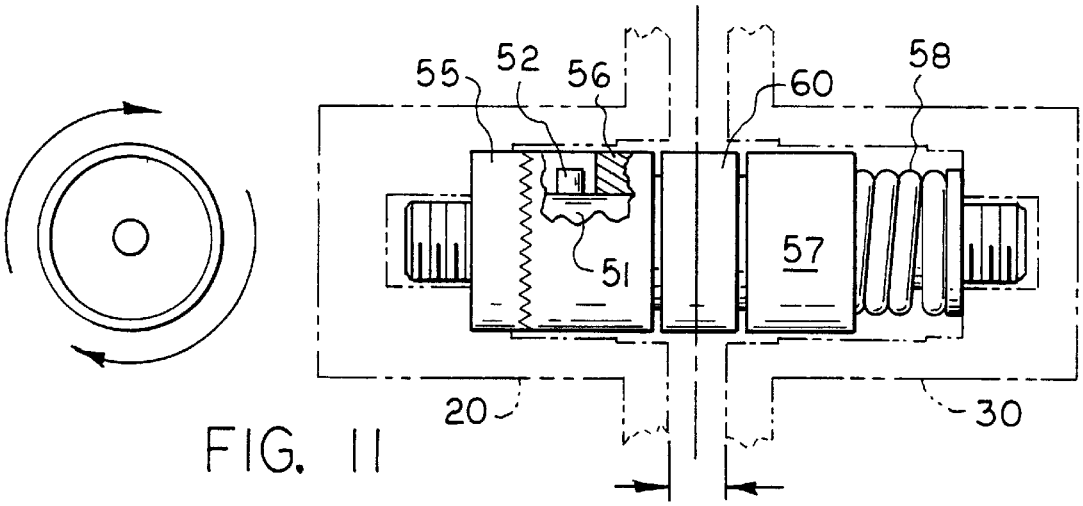
FIG. 11 is a view similar to that of FIG. 10, but after a clockwise turn of the second yo relative to the first yo has been effected, thereby decreasing the string gap.
Figure 12:
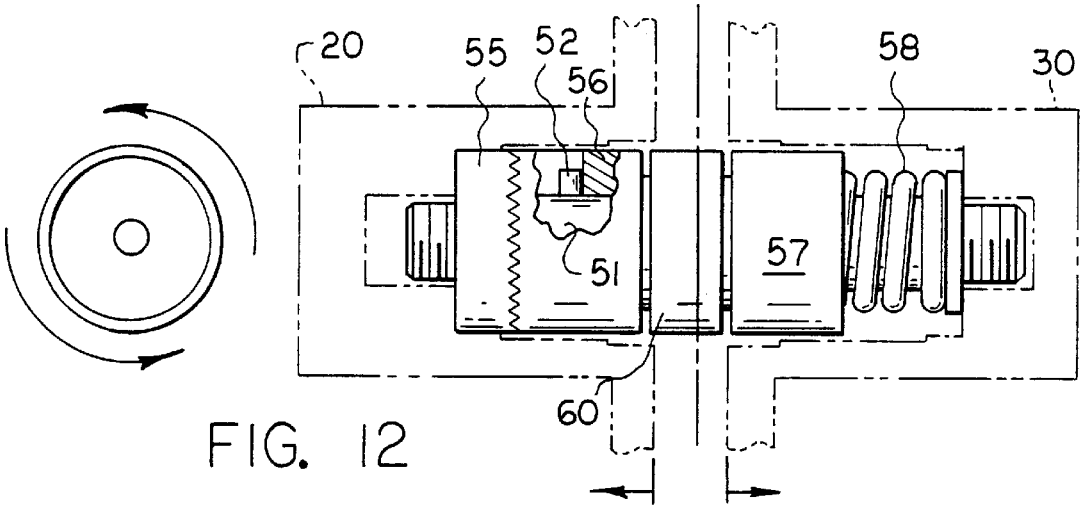
FIG. 12 is a view similar to that of FIG. 10, but after a counterclockwise turn of the second yo relative to the first yo has been effected, thereby increasing the string gap.

A nominal gap width (factory setting) of 0.095 is illustrated in FIG. 10. FIG. 11 illustrates the state of the ratchet mechanism after the second yo has been turned in a clockwise direction relative to the first yo and relative to the state of the mechanism as shown in FIG. 10. In FIG. 11, although it is not readily discernible in the drawing, the gap between the yos has narrowed as a result of the clockwise rotation of the second yo. Note that the roll pin in FIG. 11 is displaced leftwardly with respect to its position in FIG. 10. FIG. 12 illustrates the state of the ratchet mechanism after the second yo has been turned in a counter-clockwise direction relative to the first yo and relative to the state of the mechanism as shown in FIG. 10. In FIG. 12, although it is not readily discernible in the drawing, the gap between the yos has widened as a result of the counter-clockwise rotation of the second yo. Note that the roll pin in FIG. 12 is displaced rightwardly with respect to its position in FIG. 10.

In the event the yo-yo tether becomes entangled or knotted in the string gap, which commonly occurs in any yo-yo, the first yo is easily removed by simply rotating it counter-clockwise, separating it from the axle completely. Observe that when this is done, the remainder of the yo-yo remains intact; no parts fall away. The initial firm engagement of the axle threaded end in the second yo keeps it in place against the torque needed to unscrew the first yo—specifically the relatively high torque needed to first disengage the ratchet teeth. With the first yo removed, the washer remains captured at the right shoulder of the axle and the compression spring, still under considerable residual compression, holds itself, the spring collar, ball bearing, and passive ratchet firmly captured between the washer and the roll pin.

At all points in the one full turn adjustment range of the mechanism the compression spring provides sufficient pressure between the active and passive ratchet teeth to prevent unwanted accidental "skipping" of teeth in all but the most aggressive yo-yo play.

Figure 18:
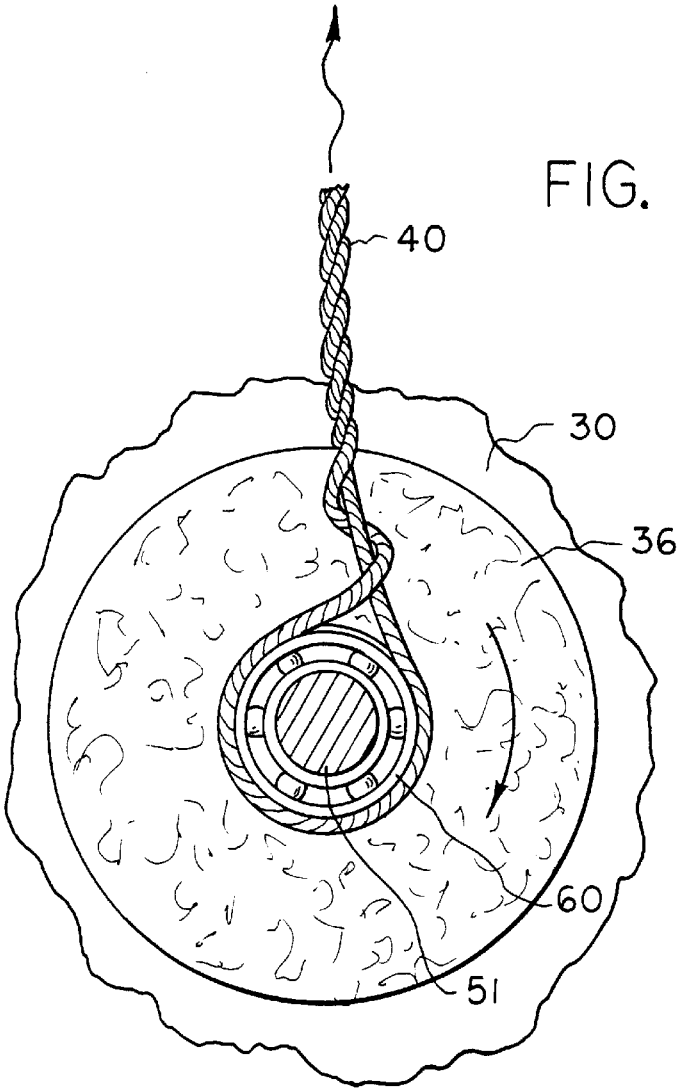
FIG. 18 is a fragmentary partial cross-sectional view taken generally along line 18—18 in FIG. 17.
Figure 17:
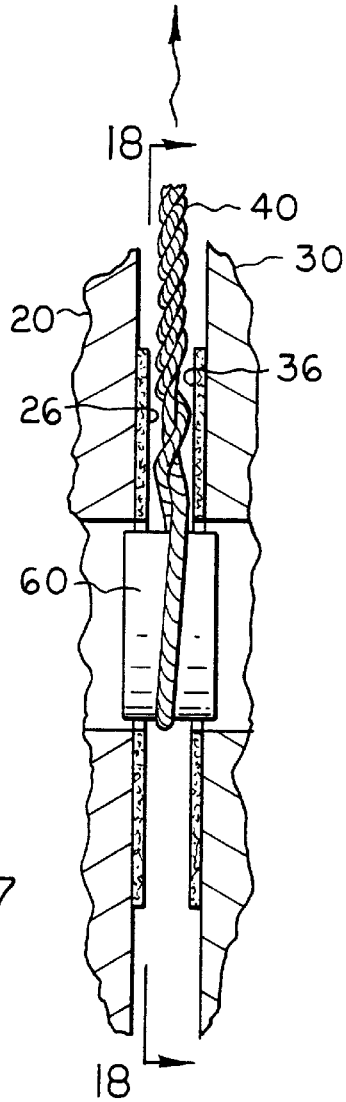
FIG. 17 is a fragmentary partial cross-sectional view of the yo-yo showing the tether in a slackened orientation.

We now address and explain operation of the fibrous disks. The disks in operation are best understood in their interaction with the yo-yo tether while the yo-yo spins. Yo-yo players want the yo-yo to spin as freely and as long as possible during the performance of a trick or series of tricks. They know that to accomplish this, continued attention must be paid to keeping tension on the string while the yo-yo spins while hanging of its own weight, or through centrifugal force while the yo-yo is caused to fly in circles or arcs about the player's hand. Further, players know that the plane of the string gap is best kept accurately in line with the axis of the string. FIGS. 19 and 20 show that the string tension maintains a symmetrical "tear-drop" shape in the loop about the axle bearing, and that the string centerline is straight and parallel with the yos. While the tether centerline may not be accurately at the center between the yos, it should be clear that, so long as there is tension on the tether, pressured and lateral contact between the tether and disks (one or the other) is avoided or kept at a minimum. At any time the player allows the tension in the tether to be removed (preferably by intention, rather than lack of skill or attention); FIGS. 17 and 18 show that the relaxed tether exhibits very significant distortions, occurring in the vicinity of the first twist of the double strand and from there in the single strand loop about the axle bearing periphery. There are three known sources of these distortions:

1. The internal tightness of twist of the single strand (of which the twisted double strand yo-yo tether is formed), allows "kinks" to occur anywhere in the double strand and anywhere in the single strand in the "tear-drop" encircling the axle bearing.

2. So-called "frictionless" ball bearings in fact have some rolling friction between the inner and outer race. That rolling friction, with the spinning inner race as the source, produces a slight but significant torque to pull the right hand single strand and (through more than 180 degrees of contact capstan friction) throw slack to the left hand single strand. Even minimal interaction between the fibers of the cotton string and the disks works with the function of the torque just described to pull the right single strand and throw slack to the left single strand. Major distortions then appear in the slack single strand at the left as the whole teardrop is shortened and the string begins to follow the rotation of the spinning disks.

3. A rapidly spinning yo-yo creates significant wind action in the tether gap; an action greatly enhanced by the "whiskers" of the fibrous disks. This action further enhances the effects described in paragraphs 1 & 2 above in the interaction between string and disks, so long as the string is slack.

FIG. 17 makes it clear that any significant distortion causes abruptly increased physical interaction among the extended fiber ("whiskers" not shown here, see FIG. 16) of the cotton string and those of the fibrous disks. With this increased interaction, continuing slackness of the string, and continued spinning of the yos, the disks now pull more of the string double strand (and ever more string "whiskers") into the gap between the disks. In the end, the teardrop is drawn to a full wrap about the axle bearing; the double strand is pulled into position alongside the already distorted single strand at the axle bearing periphery where now the string abruptly wedges forcefully between the disks. Here the momentum of the spinning yo-yo winds the tether to the point of tension again between the yo-yo and the player's hand, causing the yo-yo to fully and tightly rewind the string and return the yo-yo to the player's hand.

In a preferred embodiment, a target or nominal gap is 0.110" measured between the inwardly facing surfaces of the first and second yos, or 0.095" as measured between the fibrous pads. The 0.095" gap is specified because of certain "String Tricks" to allow room for the single strand (roughly 0.030" diameter) to move to the side in the gap to make room for the double twist section of the string (roughly 0.050" diameter) to lay in at the surface of the axle bearing. Both the single strand and double twist section avoid forceful contact with the spinning fibrous pads, and both are maintained under tension by the player to keep the interaction of cotton string and fibrous pad from initiating a rewind. It is the presence of the opposing cotton and fibrous pad fibers, that allow the wide (0.095" or larger) gap while the string in the gap is under tension, yet reliably initiate a return at the termination of the trick (where there is only the single strand in the gap) where tension is released and the string distortion occurs initiating the return wind-up.

Thus it is seen that the objects of the present invention are efficiently obtained. The preceding description of a preferred embodiment and best mode of practicing the invention are disclosed to enable one having ordinary skill in the art to make and use the invention, and to appreciate the novel aspects of the invention. However, the preceding description is not intended to limit the scope of the appended claims, as modifications, changes and substitutions to the invention without departing from the scope and spirit of the invention.

What I claim is:

1. An improved yo-yo, comprising:

a first yo having a first inwardly facing surface;

a second yo having a second inwardly facing surface, said second yo arranged in spaced apart relation to said first yo, where said first and second inwardly facing surfaces face one another;

an axle secured to and arranged between said first yo and said second yo, where said first and second yos are arranged for rotation about an imaginary axis coincident with said axle; and, a first fibrous pad secured to said first inwardly facing surface.

2. An improved yo-yo as recited in claim 1 further comprising a second fibrous pad secured to said second inwardly facing surface.

3. An improved yo-yo as recited in claim 2 wherein said first and second fibrous pads are annular linen disks, each of said disks has a central aperture and said axle passes through each of said apertures in the disks.

4. An improved yo-yo as recited in claim 2 further comprising a bearing member mounted on said axle, said bearing having an inner race slidably mounted on said axle and arranged for rotation therewith.

5. An improved yo-yo as recited in claim 4, further comprising a tether having a portion thereof attached to and in sliding engagement with said outer race of said bearing.

6. An improved yo-yo as recited in claim 5 wherein said tether is made of cotton.

7. An improved yo-yo as recited in claim 5 wherein said tether comprises outwardly extending fibers, said first and second fibrous pads comprise outwardly extending fibers, and said tether and yo-yo are operatively arranged to cause said outwardly extending fibers of said tether to interact with said outwardly extending fibers of at least one of said first and second fibrous pads when said tether is slackened by a user of said yo-yo.

8. An improved yo-yo as recited in claim 2 wherein said second fibrous pad is detachably secured to said second inwardly facing surface.

9. An improved yo-yo as recited in claim 8 wherein said second inwardly facing surface includes a recessed portion and said second fibrous pad is detachably secured to said second inwardly facing surface, including said recessed portion.

10. An improved yo-yo as recited in claim 1 wherein said first fibrous pad is detachably secured to said first inwardly facing surface.

11. An improved yo-yo as recited in claim 10 wherein said first inwardly facing surface includes a recessed portion and said first fibrous pad is detachably secured to said first inwardly facing surface, including said recessed portion.

12. An improved yo-yo, comprising:

a first yo having a first inwardly facing surface;

a second yo having a second inwardly facing surface, said second yo arranged in spaced apart relation to said first yo, creating a gap having a length between said first and second inwardly facing surfaces;

an axle having a first end and a second end, said first end adjustably secured within a partial through-bore in said first yo, said second end fixedly secured within a partial through-bore in said second yo, where said first and second yos are arranged for rotation about an imaginary axis coincident with said axle;

a greaseless ball bearing mounted on said axle; and, a ratchet assembly operatively arranged to change the length of said gap in response to rotation of said first yo relative to said second yo.

13. An improved yo-yo as recited in claim 12 wherein said greaseless ball bearing includes an inner race slidably mounted to said axle and arranged for rotation therewith.

14. An improved yo-yo as recited in claim 12 wherein said ratchet assembly comprises a passive ratchet member and an active ratchet member, both of which are mounted in said first yo, and a spring mounted in said second yo.

15. An improved yo-yo as recited in claim 12 further comprising a first fibrous pad secured to said first inwardly facing surface.

16. An improved yo-yo as recited in claim 15 further comprising a second fibrous pad secured to said second inwardly facing surface.

17. An improved yo-yo as recited in claim 16 wherein said second inwardly facing surface includes a recessed portion and said second fibrous pad is detachably secured to said second inwardly facing surface, including said recessed portion.

18. An improved yo-yo as recited in claim 16 wherein said first and second fibrous pads are annular linen disks, each of said disks has a central aperture and said axle passes through each of said apertures in the disks.

19. An improved yo-yo as recited in claim 15 wherein said first inwardly facing surface includes a recessed portion and said first fibrous pad is detachably secured to said first inwardly facing surface, including said recessed portion.

20. An improved yo-yo as recited in claim 12 further comprising a bearing member mounted on said axle, said bearing having an inner race slidably mounted on said axle and arranged for rotation therewith.

21. An improved yo-yo as recited in claim 20, further comprising a tether having a portion thereof attached to and in sliding engagement with said outer race of said bearing.

22. An improved yo-yo as recited in claim 21 wherein said tether is made of cotton.

23. An improved yo-yo as recited in claim 21 wherein said tether comprises outwardly extending fibers, said first and second fibrous pads comprise outwardly extending fibers, and said tether and yo-yo are operatively arranged to cause said outwardly extending fibers of said tether to interact with said outwardly extending fibers of at least one of said first and second fibrous pads when said tether is slackened by a user of said yo-yo.

24. An improved yo-yo, comprising:

a first yo having a first inwardly facing surface and having a first threaded partial through-bore therein;

a second yo having a second inwardly facing surface, said second yo arranged in spaced apart relation to said first yo, creating a gap having a length between said first and second inwardly facing surfaces, said second yo having a second threaded partial through-bore therein;

an axle having a first threaded end and a second threaded end, said second threaded end completely threaded into said second threaded partial through-bore, said first threaded end partially threaded into said first threaded partial through-bore, where said first and second yos are arranged for rotation about an imaginary axis coincident with said axle;

a ratchet assembly operatively arranged to change the length of said gap in response to rotation of said first yo relative to said second yo, said ratchet assembly comprising:

an active ratchet member fixedly secured about said axle within said first yo proximate said first end of said axle, said active ratchet member having a plurality of inwardly facing engagement teeth;

a roll pin extending transversely from said axle and fixedly secured thereto;

a passive ratchet member mounted to said axle proximate said active ratchet member, said passive ratchet member having a plurality of outwardly facing engagement teeth arranged to engage the engagement teeth of the active ratchet member, said passive ratchet containing a slot arranged to receive said roll pin;

a ball bearing mounted to said axle proximate said passive ratchet;

a spring collar mounted to said axle proximate said ball bearing; and, a compression spring disposed between an inner surface of said second yo and said spring collar, and operatively arranged to exert a biasing force upon said spring collar, ball bearing and passive ratchet;

whereby turning said second yo in a clockwise direction causes said ratchet assembly to function to shorten said gap, and turning said second yo in a counterclockwise direction causes said ratchet assembly to function to lengthen said gap.

25. The improved yo-yo recited in claim 24, further comprising a first fibrous pad detachably mounted to said first inwardly facing surface.

26. The improved yo-yo recited in claim 25, further comprising a second fibrous pad detachably mounted to said second inwardly facing surface.

* * * * *